United States Patent [19]

Grover et al.

[11] Patent Number: 4,640,347

[45] Date of Patent: Feb. 3, 1987

[54] HEAT PIPE

[75] Inventors: George M. Grover; Robert H. Chrisman, both of Los Alamos, N. Mex.

[73] Assignee: Q-dot Corporation, Garland, Tex.

[21] Appl. No.: 600,478

[22] Filed: Apr. 16, 1984

[51] Int. Cl.[4] ..... F28D 15/00

[52] U.S. Cl. ..... 165/104.26; 165/104.21; 165/104.33

[58] Field of Search ..... 165/104.26, 104.21

[56] References Cited

U.S. PATENT DOCUMENTS

| | | | |
|---|---|---|---|
| 3,753,364 | 8/1973 | Runyan et al. | 165/104.26 |
| 4,058,159 | 11/1977 | Iriarte | 165/104.21 |
| 4,426,959 | 1/1984 | McCurley | 165/104.21 |

FOREIGN PATENT DOCUMENTS

| | | | |
|---|---|---|---|
| 22272 | of 1893 | United Kingdom | 165/104.21 |
| 899328 | 6/1962 | United Kingdom | 165/104.21 |
| 981083 | 1/1965 | United Kingdom | 165/104.21 |

*Primary Examiner*—Albert W. Davis, Jr.
*Attorney, Agent, or Firm*—Hubbard, Thurman, Turner & Tucker

[57] ABSTRACT

Relatively small diameter heat pipes having generally horizontally arranged evaporator sections and inclined or vertically oriented condenser sections are provided with a flow separator for conducting working fluid vapor from the evaporator section to the condenser section and liquid working fluid is returned to the evaporator section in the flow passage formed between an outer cylindrical tubular member and an inner cylindrical member forming the flow separator. The flow separator may be formed as a cylindrical tube positioned within the outer tubular envelope such that the ends of the flow separator are open and are spaced from the end closures of the outer tube by a small distance. The hydraulic radius of the inner tube flow path is equal to or greater than the hydraulic radius of the annular passage formed between the tubes.

7 Claims, 9 Drawing Figures

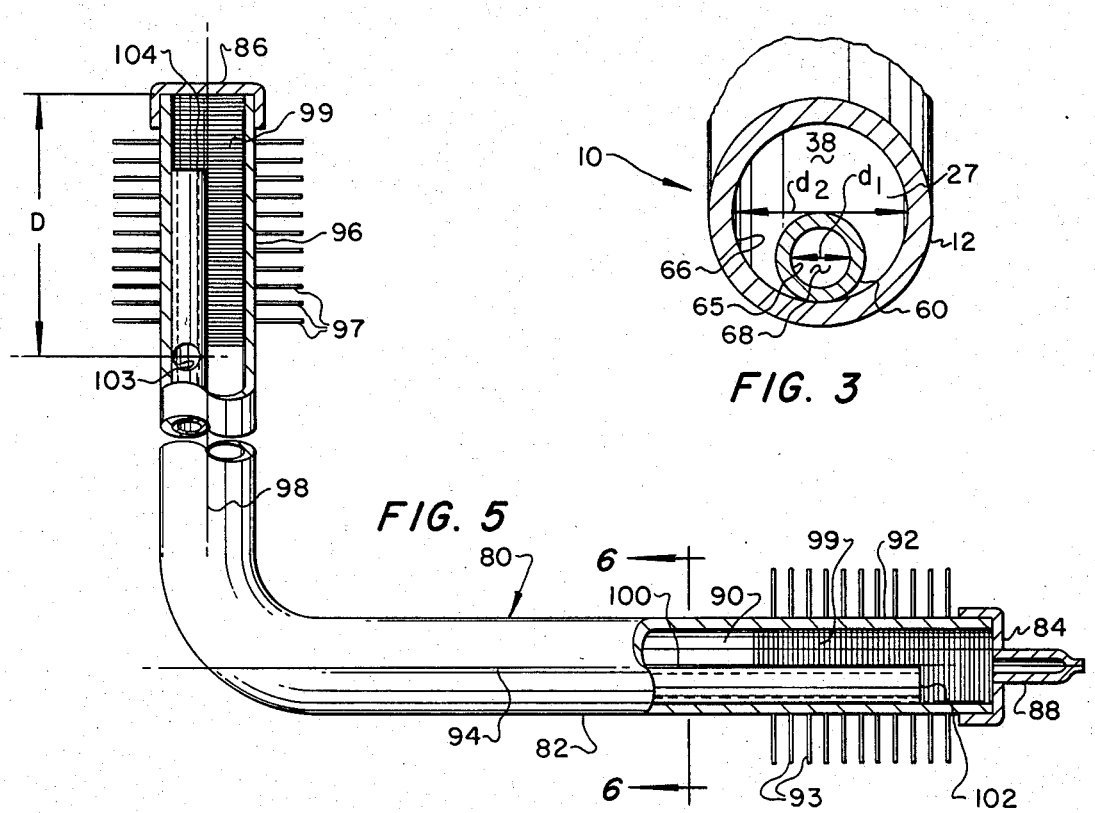
FIG. 5
FIG. 3
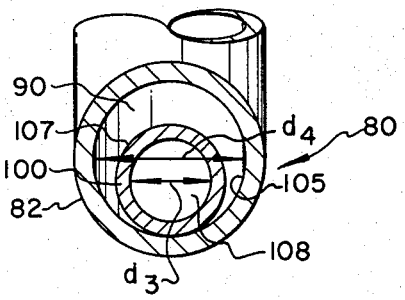
FIG. 6
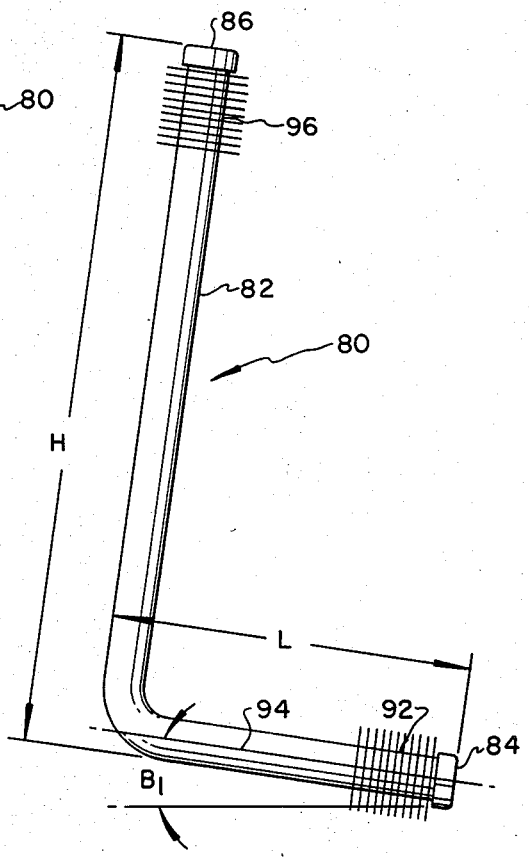
FIG. 7

HEAT PIPE

BACKGROUND OF THE INVENTION

1. Field of the Invention

This invention pertains to a heat transfer device of the general type referred to as a heat pipe and comprising an elongated sealed tube or pipe containing a working fluid which is substantially continuously evaporated, transported and condensed to transfer heat.

2. Background

In the art of heat transfer devices, the heat pipe has found substantial commercial application. Heat pipes are particularly advantageous for applications where heat must be transferred between a source, usually a fluid, to a sink, also usually a fluid, and wherein the fluids or other forms of source and sink cannot be mixed or even brought into close proximity to one another. Heat pipes are also advantageous because of their structural simplicity and their heat transfer capacity as compared with their physical bulk.

However, prior art types of heat pipes have certain limitations with regard to their application in situations where the evaporator section of the heat pipe is required to be very small but also be capable of transferring a relatively high rate of energy away from a source of heat such as certain types of electronic equipment or other equipment wherein more conventional heat transfer apparatus cannot be used. Prior art heat pipes also do not function reliably in applications wherein the evaporator section must be maintained in a generally horizontal configuration and the condenser section of the heat pipe is required to be elevated with respect to the evaporator section. Certain other problems associated with heat pipes include that of starting the flow of fluid in the desired flow path within the heat pipe during operational start-up of the heat pipe itself.

Early developments in the art of heat pipes are traced to the devices described in British Patent specification No. 22,272, accepted Dec. 2, 1893, to Perkins et al. The Perkins et al patent describes various configurations of elongated closed-end tubes or pipes adapted for transferring heat between a source and a sink by the evaporation of a fluid medium such as water in an evaporator section of the tube and transmission of the water vapor to the opposite end of the tube which is exposed to a source of fluid for cooling and condensing the vapor within the tube and whereby it is intended that the condensed fluid flow back to the evaporator section in a substantially continuous operating cycle.

It has been found that the teachings of the Perkins reference are severely limited with respect to the concept of a closed-end heat pipe utilizing water as a working fluid. For example, Perkins fails to suggest how much working fluid in liquid form should be used with the various embodiments described in the reference, suggests that the working position of the pipes never be horizontal, and suggests that water cannot be used with a tube or pipe having less than 0.50 inches inside diameter. Most of the tubes described in the Perkins reference are not provided with any internal structure, such as wicking or flow separator devices, with the exception of an embodiment having a central web extending substantially throughout the length of the pipe and an embodiment having a so-called tube within a tube.

The disadvantages of the Perkins tubes, including the embodiment of a tube within a tube, have been pointed out in my prior U.S. Pat. No. 4,020,898 (herein referred to sometimes as the '898 patent), issued May 3, 1977, and assigned to the assignee of the present invention, Q-dot Corporation, Garland, Tex. The '898 patent is directed to an improvement in heat pipes having relatively long or large area evaporator and condenser sections wherein a so-called flow separator tube is provided within the envelope of the heat pipe itself for conducting the condensed liquid from the condenser section back to the evaporator section so as to avoid the problems connected with single tube heat pipes without flow separating structure. The tube within a tube type of heat pipe disclosed and claimed in the '898 patent holds certain advantages over heat pipes which are provided with capillary wick structures, as the latter are difficult and expensive to install properly within the outer envelope tube of a heat pipe.

Although the configuration of the heat pipe described in the '898 patent overcomes certain problems associated with the simple heat pipe, or Perkins tube, and heat pipes with capillary wick structures, it was previously believed that the flow of working fluid vapor from the evaporator section to the condenser section must take place in the space between the inner wall surface of the outer tube or envelope and the outer wall surface of the flow separator or inner tube. In fact, a substantial body of patent literature and many years of testing and development by this art worker have indicated that the so-called conventional mode of circulation of working fluid was necessary for reliable operation of heat pipes.

It was determined in accordance with the '898 patent that the flow separator or liquid return tube should have an inside diameter equal to approximately 30% to 40% of the inside diameter of the outer tube, the liquid return tube should be between 65% and about 85% of the length of the outer tube, and the working fluid, in the liquid phase at working temperatures, should fill about 50% and 75% of the volume of the outer tube. Moreover, the heat pipe disclosed in the '898 patent has relatively long evaporator and condenser sections, which may, in fact, extend toward a point almost contiguous with each other and be separated by a wall or partition.

The improvements described and claimed in U.S. Pat. No. 4,020,898 show substantial superiority over the Perkins tubes with flow separator structure. However, in commercial applications the improved heat pipe described in the '898 patent is generally limited to a substantial straight pipe, is limited to a minimum diameter of 0.50 to 0.75 inches, and performs best when the evaporator section is inclined downward with respect to the horizontal.

As a result of the experiments with the Perkins tube described in the '898 patent, it was not believed that a heat pipe could be satisfactorily developed which has a horizontally disposed, or near horozintally disposed, and relatively small area, or short, evaporator section and which also could utilize a generally tubular flow separator of the type previously developed. This is particularly true for relatively long heat pipes and those arranged wherein an intermediate or so called adiabatic section and the condenser section must be inclined upward with respect to the evaporator section. It has also been believed that heat pipes with relatively short evaporator and condenser sections on the order of 10% and 25% to 30%, respectively, of the overall tube length could not be reliably started in a conventional or reverse mode of fluid flow between the respective evaporator and condenser sections.

Moreover, in accordance with prior art developments, it was believed that the dimensional parameters for the flow separator or liquid return tube should adhere to the limits described in the '898 patent. The prior art configurations of heat pipes have also been characterized by the requirement for relatively long evaporator sections in order to assure reliable starting and operation since localized or concentrated applications of heat to small areas of the evaporator section tend to form pockets of vapor which block the counterdirectional flow of the working fluid. This has prevented application of heat pipes to situations wherein very concentrated sources of heat are generated in small spaces and at high rates, such as in various types of electronic equipment previously mentioned.

However, with the need to develop a heat pipe having a generally horizontal, short evaporator section and with the need to develop heat pipes having a wide range of lengths (10 to 150 inches) and relatively small diameters (less than 0.50 inches), it has been determined that a heat pipe operating in a mode substantially the reverse of that previously known and suggested by the prior art is capable of reliable starting under a wide variety of heat rate or power applications, has a heat transfer rate capacity equal to or superior to other known types of heat pipes, has coefficients of heat transfer for the respective evaporator and condenser sections greater than heat pipes operating in the so-called normal mode and is particularly adapted for use with concentrated sources of heat applied to a small area of the evaporator section. For purposes of description herein, the so-called normal or conventional mode of operation is that wherein, with a tubular-type flow separator or fluid conduit within the envelope of the outer tube, vapor flows from the evaporator section to the condenser section in the annulus formed between the inner and outer tubes and the inner tube is adapted to carry liquid from the condenser section to the evaporator section. The heat pipe of the present invention is adapted for operation in the so-called reverse mode wherein a tubular conduit is provided within the envelope of the outer tube of the heat pipe and which is operable to carry working fluid vapor from the evaporator section to the condenser section. The condensed liquid working fluid is returned to the evaporator section in the generally annular passage formed between the inner wall of the outer tube and the outer wall of the inner tube.

SUMMARY OF THE INVENTION

The present invention provides a heat transfer device of the general type known in the art as heat pipes wherein an elongated outer tubular member is sealed at both ends, is partially filled with a working fluid operable to evaporate and condense at the working temperatures of the device and which is provided with a member disposed within the envelope of the outer tube for conducting vapor of the working fluid from the evaporator section to the condenser section of the heat pipe and wherein liquid of the working fluid is returned to the evaporator section through the passage defined between the inneer surface of the outer tube and the inner member.

In accordance with one aspect of the present invention, there is provided an improved heat pipe having an evaporator section with a relatively small heat transfer surface area through which heat may pass to the working fluid, yet which is operable to undergo reliable starting and continuous heat transfer operation in the reverse mode wherein working fluid evaporated in the evaporator section flows as vapor through an inner tubular member or flow separator structure to the condenser section of the heat pipe where it is then returned to the evaporator section through a generally annular passage formed between inner and outer tubular members so that vapor is condensed as it travels through the annular passage. For thinwalled cylindrical tubular members, the ratio of the inner diameter of the inner tubular member comprising the flow separator or vapor conduit to the inner diameter of the outer tubular member is preferably at least 0.45 to 0.55 and, more significantly, resistance to fluid flow through the inner tubular member is equal to or less than the resistance to fluid flow through the annular passage formed between the tubular members.

In accordance with another aspect of the present invention, there is provided an improved heat pipe capable of reliable starting and continuous operation which is of a configuration wherein the evaporator section of the heat pipe may be disposed generally horizontally and be connected through an adiabatic section of the heat pipe to a condenser section which is inclined with respect to the evaporator section in an upward direction whereby gravitational forces may be effective to return condensed working fluid from the condenser section to the evaporator section. The improved heat pipe is operable to work effectively with relatively short evaporator and condenser sections and the evaporator section may be inclined upwardly in the same direction as the condenser section or may be inclined in the opposite direction, with respect to the horizontal.

In accordance with yet a further aspect of the present invention, there is provided an improved heat pipe having a tubular flow separator structure disposed within the envelope of an outer tubular member of the heat pipe and which is configured such that reliable starting and continuous operation may be carried out in heat pipes of a wide range of lengths in the reverse mode of flow of the working fluid between the evaporator and condenser sections. This operation may be carried out using thinwalled heat pipes of nominal diameters less than 0.50 inches and having evaporator sections which are disposed generally horizontally or inclined upwardly or downwardly with respect to a condenser section.

In accordance with yet a further aspect of the present invention, there is provided a heat pipe of a type utilizing an outer tubular member characterized as a relatively thinwalled thermally conductive metal tube closed at both ends to form a sealed envelope in which is disposed a tubular member or flow separator, also formed of a relatively thinwalled metal tube which is of a length slightly less than the length of the outer tubular member and is open at both ends to the interior envelope of the outer tubular member in what are designated as the evaporator sections and condenser sections of the heat pipe.

In one preferred embodiment the flow separator tube includes a bypass port therein having a cross sectional flow area preferably equal to the flow area of the flow separator tube and disposed about 13% to 17% of the length of the outer tube from the end of the outer tube defining the condenser section. Heat pipes with evaporator and condenser sections no more than 3% to 5% of overall outer tube length can be demonstrated to start in the reverse mode with the modified flow separator tube.

A heat pipe in accordance with the invention is also preferably partially filled with a working fluid such as water which, at the working temperature of the pipe, occupies about 35% to 45% of the total volume of the envelope defined by the outer tubular member. The condenser section, preferably, may have an effective length or surface area 1.0 to 10.0 times the length or effective surface area of the evaporator section. A heat pipe in accordance with the present invention also has a flow path for vapor flowing to the condenser section defined by a flow separator structure and having a hydraulic radius equal to or greater than the hydraulic radius of a generally annular liquid return passage from the condenser section to the evaporator section.

Although certain features of the invention have been described hereinabove, those skilled in the art will further appreciate the above mentioned aspects of the invention as well as other important advantages upon reading the following detailed description in conjunction with the accompanying drawing.

BRIEF DESCRIPTION OF THE DRAWING

FIG. 3 is a transverse section view taken along the line 3—3 of FIG. 2;

FIG. 5 is a longitudinal side elevation, partially sectioned, of another embodiment of a heat pipe in accordance with the present invention;

FIG. 6 is a section taken along the line 6—6 of FIG. 5;

FIGS. 7 and 8 are side elevation views showing the heat pipe of FIG. 5 in alternate working positions.

DESCRIPTION OF THE PREFERRED EMBODIMENTS

Figure 1:
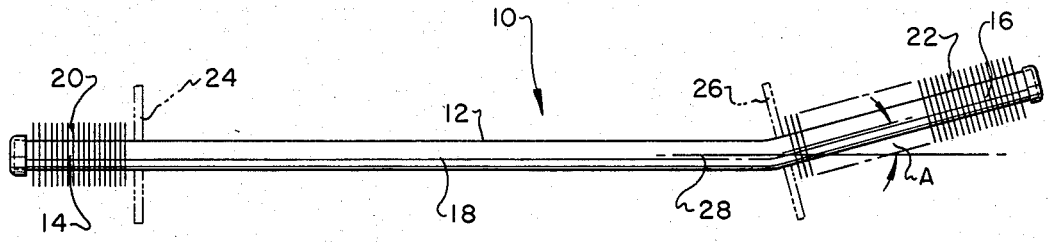
FIG. 1 is a longitudinal side elevation of a heat pipe in accordance with present invention.

In the description which follows, like parts are marked throughout the specification and drawing with the same reference numerals, respectively. The drawing figures are not necessarily to scale and certain features of the invention may be shown exaggerated in scale or in schematic form in the interest of clarity.

Referring to FIG. 1, there is illustrated an embodiment of a heat transfer device, generally designated by the numeral 10, and characterized in the art of heat transfer devices as a heat pipe. The heat pipe 10 comprises a relatively small diameter, elongated, thinwalled tubular member 12 having an evaporator section 14, a condenser section 16, and an intermediate section 18 which typically is arranged to prevent the transfer of heat into or out of the heat pipe and is generally referred to as the adiabatic section. The evaporator section 14 is provided with means for enhancing the flow of heat between the interior of the heat pipe and the exterior comprising, for example, a plurality of spaced apart heat transfer fins 20. The condenser section 16 is also provided with heat transfer fins 22. The fins 20 and 22 are typically provided in a heat pipe such as the pipe 10 wherein heat transfer to the evaporator section and from the condenser section is by way of a fluid flowing over the respective sets of fins, although the respective sections may be in heat conductive relationship with other structures. The evaporator section 14 is preferably isolated from the remainder of the heat pipe by a suitable shield such as a wall 24 or the like and may also terminate at a point spaced from the end 13 of the tube 12. In like manner, the condenser section 16 may be isolated by a partition or wall 26.

The heat pipe 10 is closed at its opposite ends 13 and 15 to form an interior chamber 27 which is at least partially filled with a working fluid, typically water. The outer tubular member 12 is typically formed of thinwalled heat conductive metal such as copper or aluminum alloy. The exemplary heat pipe 10 is particularly adapted for orientation of the evaporator and adiabatic sections in a generally horizontally disposed position and the condenser section 16 is formed at an inclined angle A with respect to the horizontal central longitudinal axis 28 of the evaporator section 14 and the adiabatic section 18. The exemplary heat pipe 10 is formed of a relatively thinwalled copper tube of 0.625 inches outside diameter, has an evaporator section about sixteen inches in length, an adiabatic section about one hundred inches in length and a condenser section about forty inches long.

Figure 2:
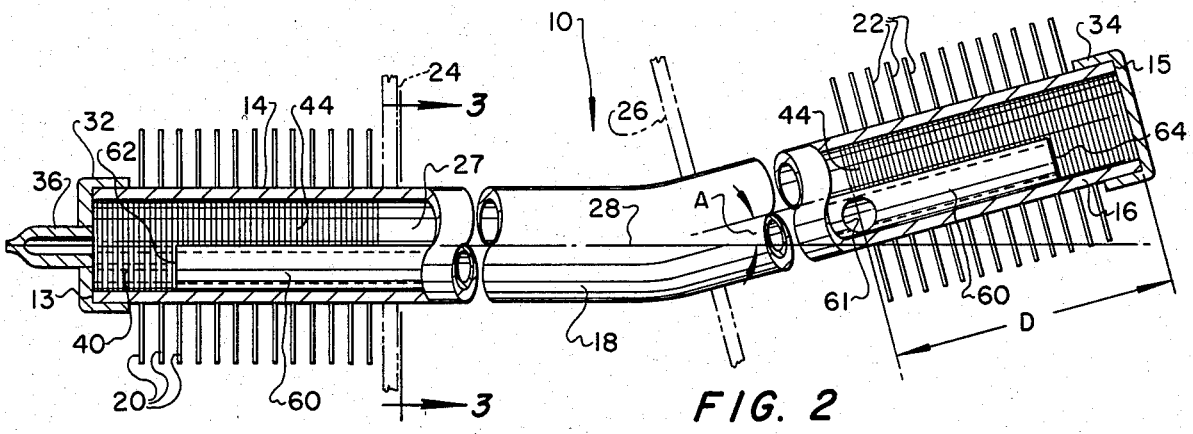
FIG. 2 is a side elevation of the heat pipe shown in FIG. 1, partially sectioned, and in a larger scale.

Referring also to FIG. 2, the heat pipe 10 preferably includes end caps 32 and 34 forming the closed ends 13 and 15, respectively. The end cap 32 is provided with a closure member 36 through which the interior chamber 27 of the tube 12 may be partially evacuated, if desired, and filled with a preselected amount of a working fluid 40, such as distilled water. The interior wall surface 42 of the tube 12 may be formed with suitable wicking 44 in the form of spiral circumferential grooves along the evaporator section 14 and along the condenser section 16 in accordance with the teachings of my U.S. Pat. No. 3,865,184, also assigned to Q-dot Corporation. The wicking 44 is useful in enhancing the evaporation and condensation of the working fluid and, hence, heat transfer during operation of the heat pipe.

Figure 4:
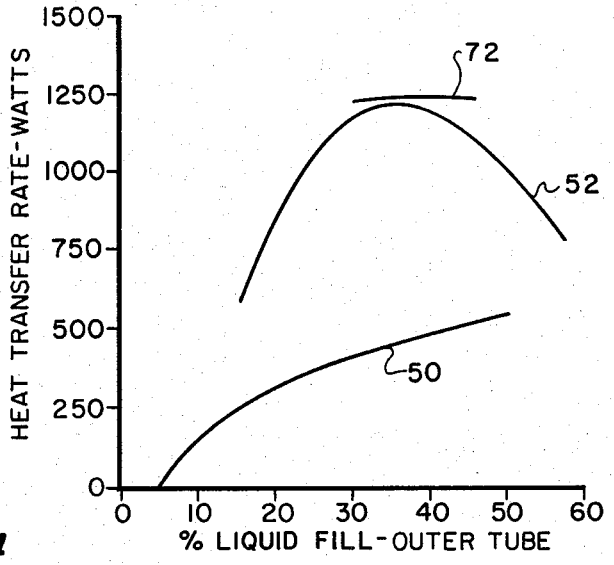
FIG. 4 is a diagram illustrating the heat transfer characteristics of the heat pipe illustrated in FIG. 1 as compared with other heat pipes.

As previously mentioned, a recognized disadvantage of a heat pipe thermal transfer device of the type described in the Perkins patent is that generally straight pipes, or pipes with generally horizontally arranged evaporator sections, are not reliable in operation and are generally of relatively low heat transfer capacity. A heat pipe similar to the heat pipe 10, for example, but without any form of internal flow separating structure, has a heat transfer rate capacity generally in accordance with the curve 50 of the diagram of FIG. 4. Referring to FIG. 4, there is illustrated a plot of the operating characteristics of heat pipes with and without flow separating structure, to be described further herein, on the basis of the pipe being filled with various amount of working fluid. The abscissa of the diagram of FIG. 4 represents the percentage of the total volume of the interior chamber 27 of the tube 12 not considering the volume occupied by flow separating structure in the chamber and filled with distilled water as a working fluid. The ordinate of the diagram of FIG. 4 represents the rate of heat transfer of various heat pipe configurations in watts for the various operating conditions associated with the curves shown in FIG. 4.

The curve 50 indicates that a heat pipe without any internal flow separating structure, is capable of transferring an increasing amount of heat between the evaporator section and the condenser section for working fluid fill conditions in the range of 5% to approximately 50% of the volume of the chamber 27. The curve 50 is also valid for the condition wherein the evaporator section 14 and the adiabatic section 18 are disposed generally horizontally and the condenser section 16 is angled upward at an angle A of approximately 15° with respect to the axis 28 as illustrated in FIGS. 1 and 2. Substantial testing to establish the data for the curve 50 has indicated, however, that operation of the aforedescribed heat pipe without any internal flow separating structure is extremely erratic and results in substantial blockage of flow of working fluid between the evaporator and condenser sections. In several instances the flow of working fluid failed to start upon application of heat to the evaporator section either gradually or with relatively high rates of heat input. These tests confirm the findings in the development of the invention in U.S. Pat. No. 4,020,898.

The curve 52 in FIG. 4 represents the performance of the aforementioned heat pipe, without flow separating structure, wherein the evaporator section 14 and the adiabatic section 18 are tilted upward in the direction of the condenser section 16 to an angle of approximately 5.7 degrees (10% slope). It will be noted that the performance of the heat spipe without flow separator structure when inclined upward from the evaporator section 14 towards the condenser section 16 improves substantially in regards to heat transfer rate up to a percentage fill of working fluid in the range of 30 to 40% of the volume of the chamber 27 and then exhibits diminishing performance with increasing percent fill of working fluid. Tests carried out to establish the curve 52 also indicate a tendency for blockage of flow of working fluid due to the flow of liquid from the condenser section to the evaporator section in slugs or waves as described in the '898 patent.

Referring again to FIG. 2, it will be noted that the heat pipe 10 is illustrated with a flow separator structure in the form of an elongated cylindrical tube 60 disposed within tube 12 and extending from the evaporator section 14 through the adiabatic section and through a substantial portion of the condenser section 16. The tube 60 is open at both of its respective ends 62 and 64 with the ends being located in the range of 0.50 inches to 1.0 inches or at least 90% of the inner diameter of tube 60 from the end walls of the chamber 27 formed by the respective caps 32 and 34. Accordingly, the tube 60 is open to each end of the heat pipe chamber 27 and forms a flow path for the working fluid between the condenser section 16 and the evaporator section 14 comprising a passage 38 which may be considered as an annulus, although the separator tube 60 is not required to be coaxial with the tube 12. In accordance with further pursuing the present invention, the tube 60 has an inner diameter $d_1$, FIG. 3, defined by the circumferential inner wall 65 in the range of at least 45% to 55% of the inner diameter $d_2$ of the tube 12 as defined by the interior circumferential wall surface 66. In determining the relationship of the diameters of the tubes 60 and 12, the presence of the wicking grooves 44 described previously is not considered.

It has been discovered in accordance with the present invention that a heat pipe of the configuration illustrated in FIGS. 1 through 3 with the flow separator or artery tube 60 having an inner diameter $d_1$ in the range of as much as 0.45 or more of the inner diameter $d_2$ of the outer tube 12, that with the evaporator section 14 in a level or generally horizontally extending position, reliable starting and operation of the heat pipe may be accomplished with the flow of working fluid in the so-called reverse mode, that is with fluid evaporated in the evaporator section 14 flowing into and through passage 68 formed by the tube 60 to the condenser section 16 followed by condensing and flow of liquid working fluid back to the evaporator section in the passage 38. The tube 60 may have a bypass port 61 communicating the passage 68 with the passage 38 at a distance D, FIG. 2, of about 15% of the length of tube 12 from the end 15 of the condenser section. The port 61 preferably has a cross sectional flow area equal to the area of passage 68.

Referring again to FIG. 4, the curve 72 indicates the performance of the heat pipe 12 with the flow separator tube 60, in the reverse operating mode, with the evaporator section 14 and adiabatic section 18 in a horizontal position and with the condenser section 16 inclined upwardly at angle A of 15°. With a liquid charge in the range of 30% of 40%, the heat transfer capacity is better than heat pipe 10 without a flow separator structure but wherein the evaporator section is inclined at a 10% slope. The curve 72 is relatively flat indicating a greater tolerance to variation in liquid fill quantities. Moreover, significantly reliable starting capability and heat transfer capacity was realized in accordance with the tests to establish curve 72 when the evaporator section 14 was effectively confined to a point starting approximately 0.50 inches inward along the tube 60 from the end 62 so that there was not a direct application of heat between the end cap 32 and the entrance to the tube 60 at the end 62. Additional tests with the tube 60 having its effective ends 62 and 64 located approximately 15% of the length of the heat pipe inboard from the end caps 32 and 34, did not significantly affect the performance of the heat pipe 10 in terms of heat transfer capacity.

As a result of the observations of the performance of the heat pipe 10 with the flow separator tube 60 operating in the so-called reverse mode and being of a substantially larger diameter than that previously thought to be suitable for good heat transfer characteristics, reliable starting and stable operation, additional tests were run with a relatively short and smaller diameter heat pipe with an evaporator section adapted to extend substantially horizontally and a condenser section extending substantially vertically upwardly with respect to the axis of the evaporator section and having a flow separator structure in the form of a generally cylindrical tube disposed within the outer tube of the heat pipe and having an even larger interior diameter in the range of approximately 55% of the inner diameter of the outer tube.

Referring to FIGS. 5 and 6, there is illustrated a second embodiment of a heat pipe in accordance with the present invention, generally designated by the numeral 80. The heat pipe 80 is characterized by an elongated cylindrical outer tube 82 which may be closed at both ends with end caps 84 and 86 similar to the end caps 32 and 34 but of a diameter to conform to the outer diameter of the tube 82. The end cap 84 is also preferably provided with a suitable closure member 88 for filling the interior chamber 90 of the outer tube 82 with a working fluid such as distilled water and for sealing the the outer tube to contain the working fluid. The heat pipe 80 is provided with a relatively short evaporator section 92, which preferably extends substantially horizontally in the arrangement illustrated in FIG. 5 and having a central longitudinal horizontal axis 94. The heat pipe 80 also has a condenser section 96 of relatively short length and extending substantially vertically or at right angles with respect to the evaporator section 92 and having a central axis 98. The evaporator section 92 and condenser section 96 may be finned at 93 and 97 respectively, and provided with internal wicking in the form of spiral grooves 99 similar to the grooves 44.

The heat pipe 80 is provided with an internal flow separator and fluid conducting structure comprising an elongated open ended cylindrical tube 100 inserted in the tube 82 and conforming generally to the shape of the tube 82 but not specifically configured to be contiguous with the tube at any point intermediate its ends. The length of the tube 100 is, however, determined to be such that the ends 102 and 104, which are both open, are disposed spaced about 0.50 inches inward from the ends caps 84 and 86 of the outer tube. In an exemplary heat pipe in accordance with the embodiment of FIGS. 5 and 6, and contrary to the teaching in the prior art, the outer tube 82 is formed of a nominal 0.312 inch outside diameter thinwalled copper tubing having an overall height H, as indicated in FIG. 7, of 13.5 inches and an overall length L of 5.5 inches. The inner tube 100 is of thinwalled copper of 0.188 inch outside diameter. The nominal tube wall thicknesses for the tubes 82 and 100 is 0.064 inches and 0.052 inches, respectively. The effecive length of the evaporator section 92 is approximately 2.0 inches and the effective length of the condenser section 96 is approximately 7.0 inches.

In both the heat pipes 80 and 10, the ratio of the effective length of the condenser section to the evaporator section is greater than one and ranges from approximately 2.5 for the heat pipe 10 to 3.5 for the heat pipe 80. It is believed that these relatively high ratios of condenser section length and the associated heat transfer surface areas to evaporator section length are partly responsible for the inability of a heat pipe with no flow separating structure or a heat pipe with a relatively small diameter flow separating tube, as suggested by the prior art, to be incapable of starting or capable of only infrequent unreliable starting when the evaporator section is arranged in a generally horizontal position or a near horizontal position. The provision of the flow separator or inner tube 100 in the heat pipe 80 assumes that the end of the tube opening into the evaporator section is disposed generally as illustrated in FIG. 6, although, as mentioned above, the remainder of the tube 100 is not held in any particular position. Accordingly, the effective cross sectional flow area of the chamber 90, formed between the inner wall surface 105 of the outer tuber and the outer wall surface 107 of the inner tube 100, is presumed to be a generally annular area defined by the difference between the circular area defined by the inner wall surface 105 of the outer tube 82 and the circular area defined by the outer diameter of the inner tube 100.

In the heat pipe 80, the ratio of the inner diameter $d_3$ of the tube 100 to the inner diameter $d_4$ of the tube 82, FIG. 6, is approximately 0.55 and the cross sectional flow area of the chamber or passage 108 formed by the inner tube 100 is approximately 70% of the cross sectional flow area of the passage formed by the chamber 90 and delimited by the inner wall surface 105 of the outer tube and the outer wall surface 107 of the inner tube. For the heat pipe 10, the cross sectional flow area of the chamber 68 of the inner tube 60 is approximately 20% of the effective cross sectional flow area of the annular chamber 38. Accordingly, for relatively small diameter heat pipes, it is apparent that cross sectional flow areas of the inner tube or flow separator of about 20% or more of the cross sectional flow area of the chamber for working fluid in liquid form promotes good starting characteristics in the so-called reverse mode of operation.

More significantly, perhaps, the resistance to fluid flow through the respective passages formed by the inner and outer tubes may determine the direction of fluid circulation. In this regard it is indicated that for the heat pipes 10 and 80, the hydraulic radii of the flow paths provided by the interior passage of the separator tubes and the flow path provided between the inner surface of the outer tube and the outer surface of the inner tube should be about equal, or the ratio of the hydraulic radius of the inner tube flow path with respect to the flow path provided between the tubes, should be greater than one and possibly at least 2.0 or more. For example, with respect to tests performed on the tubes 10 and 80, it has been assumed that the hydraulic radius of the flow path for vapor through the respective flow separator tubes 60 and 100 is $d_1/4$ and $d_3/4$, respectively. The flow path for the liquid returning from the respective condenser sections to the evaporator sections is assumed to be the so-called annular space between the inner wall surface of the outer tubes and outer diameter of the inner tubes. This type of flow channel may be assumed to have a hydraulic radius W/2 where W is equal to the annular channel width. For the heat pipe 10, W is assumed to equal ($d_2$—outside diameter of tube 60)/2 and for the heat pipe 80, W equals ($d_4$—outside diameter of tube 100)/2. For the heat pipe 80, the ratio of the hydraulic radius of the passage 108 formed within the inner tube 100 to the hydraulic radius of the liquid return passage 90 formed between the inner and outer tubes is equal to approximately 2.20. For the heat pipe 10, the ratio of the hydraulic radius of the passage 68 formed by the inner tube 60 to the hydraulic radius of the passage 38 formed between the tubes is approximately 1.0.

Another important factor in a reliable reverse mode operating heat pipe is the provision of a bypass port 103 in the wall of flow separator tube 100 having a cross sectional flow area about equal to the cross sectional flow area of the tube 100 and disposed about 13% to 17% of the overall length of the tube 82, distance D in FIG. 5, from the end of tube 82. It has been discovered during tests with the heat pipe 80 that with the evaporator section 92 arranged generally horizontally and the condenser section arranged essentially vertically, with water as the working fluid and starting the heat pipe operation from nominal room temperature or below that the provision of the port 103 provides for reliable startup in the reverse mode of flow of working fluid. Although the preferred location of the port 103 is indicated to be about 15% of the length of the tube 82 from the condenser end of the tube, as indicated in FIG. 5, in many cases the port may be located in what is essentially the 80 adiabatic section of the heat pipe when the evaporator and condenser sections are very short, in the range of less than 10% of the heat pipe length and down to 3% to 5% of the heat pipe length. Moreover, the provision of the bypass port 103 is also indicated to facilitate start up of operation of the heat pipe with the heat pipe oriented in the position indicated in FIG. 8 with the so-called negative slope of the evaporator section.

From the foregoing it can be concluded that an important development in the art of heat pipes has been provided by the present invention wherein a heat pipe is provided which may have an evaporator section arranged substantially horizontally or near horizontally with an inclined or vertically oriented condenser section, and further, by providing the cross sectional flow area of the inner tube or flow separator structure to be in the range discovered and described herein that reliable operation of a heat pipe in the so-called reverse mode can be provided, particularly in application wherein a relatively short evaporator section is provided and is subjected to high heat input rates. Reverse mode operation of a heat pipe in accordance with the present invention is advantageous. It has been determined that the coefficients of evaporation and condensation (both expressed in terms of: BTU/HR./FT.$^2$/F°) are particularly high and, therefore the evaporator section and condenser section may occupy or be provided with a relatively small heat transfer surface area as compared with heat pipes operating in the so-called normal mode.

Figure 8:
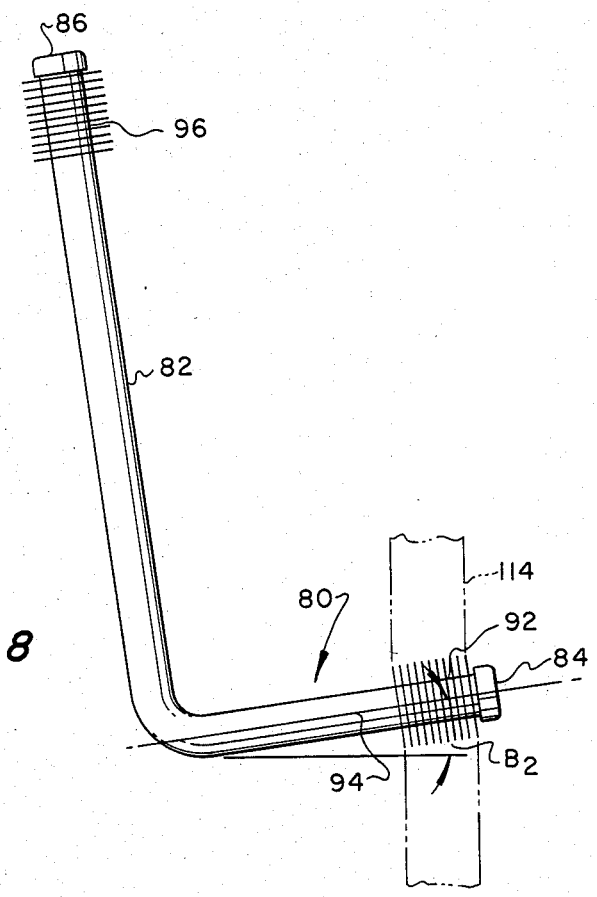
Figure 9:
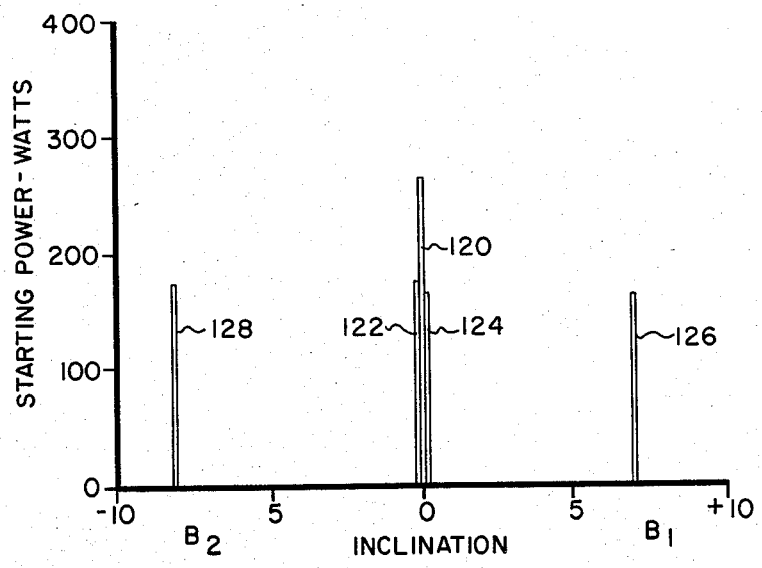
FIG. 9 is a diagram showing the starting power requirements for the heat pipe of FIGS. 5–8 in various postions of the evaporator and condenser sections.

Referring now to FIGS. 7 through 9, there is illustrated in FIG. 9 a plot of the starting power requirements for the heat pipe 80 for different attitudes of the evaporator and condenser sections, respectively. As illustrated in FIG. 7, the heat pipe 80 may be oriented such that the evaporator section 92 may be placed in an attitude wherein the longitudinal axis 94 is inclined at an angle $B_1$ of up to about 8° from the horizontal. In FIG. 8, the angular inclination of the evaporator section 92 is reversed and extends generally downwardly at an angle $B_2$ of approximately 8° from the horizontal toward the right angled condenser section 96. FIG. 8 also illustrates the application of heat to the evaporator section 92 by way of fluid flowing through a duct 114 and applied to the fins 93 at a point spaced from the end cap 84. Other means of applying heat to the evaporator section 92 may be used such as direct contact with a solid body, not shown.

FIG. 9 is a plot of the starting power requirements in watts for the heat pipe 80 for various angular positions of the heat pipe from the position illustrated in FIG. 7 wherein the evaporator section is inclined upwardly at an angle $B_1$ through a position wherein the angle B in FIGS. 7 and 8 is 0°, to the position illustrated in FIG. 8 wherein the angle $B_2$ is a −7° indicating a downward slope of the evaporator section 92 toward the condenser section. Accordingly, the diagram of FIG. 9 has an abscissa representing the angular position of the longitudinal axis of the evaporator section 92 in degrees wherein a positive angle is that as shown in FIG. 7 and a negative angle is that as shown in FIG. 8. The ordinate of FIG. 9 indicates starting power in watts required to start the heat pipe 80 in the reverse mode of operation. In all tests indicated in FIG. 9, the heat pipe 80 was filled with distilled water to about 40% of the volume of the total envelope chamber of the outer tube 82 delimited by the surface 105 and the end caps 84 and 86.

As will be noted from the bar 120, the heat pipe 80 started in the reverse operating mode from an ambient or nominal room temperature starting condition with a power input of 268 watts in a level or horizontal condition of the evaporator section 92. As indicated by the bar 122, the heat pipe 80 is also capable of starting with working fluid at an elevated temperature with a power input of 176 watts. As indicated by the bar 124, the heat pipe 80 is also capable of starting at a cold start with a power input of only 168 watts. Accordingly, it is clear from the diagram of FIG. 9 that a heat pipe 80 with a generally horizontally oriented evaporator section 92 and a flow separator structure 100 having the parameters described herein, is capable of starting in the reverse mode under different power rates.

With the same percentage fill of liquid, the heat pipe 80 has also been tested and started in the reverse mode in a position in accordance with the diagram of FIG. 7 at an angle $B_1$ of +7° with a power input of 167 watts as shown by the bar 126, and in accordance with the bar 128, with the evaporator section 92 at an angle $B_2$ of −8°, the heat pipe 80 is also capable of starting in the reverse mode at a power input of 170 watts.

From the foregoing it will be readily observed by those skilled in the art that a flow separator structure or inner tube of sufficient diameter and cross sectional flow area and with tube ends spaced from the opposite ends of the outer tube, that reliable starting in the reverse mode for different angular positions of the evaporator section is possible. Accordingly, a heat pipe which is relatively insensitive to at least slight variations in the angular position of the evaporator section, away from a true horizontal position, may be operated reliably in the inverse mode.

Although preferred embodiments of an improved heat pipe have been described herein, those skilled in the art will appreciate that various substitutions and modifications may be made to the specific structure disclosed without departing from the scope and spirit of the invention as recited in the appended claims.

What I claim is:

1. A heat transfer device comprising:

a tubular member closed at both ends to form an enclosed chamber for containing a quantity of working fluid operable to be in a liquid state and a vapor state at the working temperature of the device, said tubular member having a generally horizontally extending evaporator section at a first end and a condenser section at a second end in spaced relationship to the first end, said condenser section forming an angular extension upwardly of the evaporator section, a flow separator means for dividing the tubular member into adjust passage surrounded by a second passage, the first passage being formed a distance of not less than 90% of the inner dimension of the tubular member from the tubular member's first and second closed ends for open communication with the second passage, said first passage having an inner dimension defining the cross section of said flow path at least 45% of the inner dimension of the said tubular member, said first passage operative to pass working fluid in the vapor state from the evaporator section into the second passage at the condenser section for condensation to the liquid state and return through the second passage to the evaporator section whereby during operation of said heat pipe heat is transferred between said sections.

2. The heat transfer device set forth in claim 1 wherein:

the flow separator is a cylindrical tube forming the first passage.

3. The heat transfer device set forth in claim 1 wherein:

said condenser section extends at an angle of at least 15° to 90° with respect to the longitudinal axis of said evaporator section.

4. The heat transfer device set forth in claim 2 wherein:

the hydraulic radius of said cylindrical tube is at least as great as the hydraulic radius of said second passage.

5. The heat transfer device set forth in claim 1 wherein:

the effective heat transfer area of said condenser section is in the range of 2.5 to 3.5 times the effective heat transfer area of said evaporator section.

6. The heat transfer device set forth in claim 1 wherein:

said outer tubular member has an inner dimension no greater than about 0.50 inches.

7. The heat pipe set forth in claim 1 wherein:

said evaporator section is confined to about 10% to 11% of the overall length of said heat pipe.

* * * * *